US005601390A

United States Patent [19]

Cummings

[11] Patent Number: 5,601,390

[45] Date of Patent: Feb. 11, 1997

[54] CONVEYOR-TYPE THREE DIMENSIONAL PARKING SYSTEM

[76] Inventor: Craig N. Cummings, 73-1126 Ahulani St., Kailua-Kona, Hi. 96740

[21] Appl. No.: 511,373

[22] Filed: Aug. 4, 1995

[51] Int. Cl.[6] ..... E04H 6/00

[52] U.S. Cl. ..... 414/251; 414/227; 414/261

[58] Field of Search ..... 414/227, 231, 414/232, 251, 261

[56] References Cited

U.S. PATENT DOCUMENTS

| | | | |
|---|---|---|---|
| 2,728,467 | 12/1955 | Glicker | 414/251 |
| 3,424,321 | 1/1969 | Lichti | 414/251 |
| 4,820,107 | 4/1989 | Nevo-Hacohen | 414/261 |
| 5,018,926 | 5/1991 | Sternad | 414/240 |

FOREIGN PATENT DOCUMENTS

| | | | |
|---|---|---|---|
| 4-185873 | 7/1992 | Japan | 414/231 |

*Primary Examiner*—Thomas J. Brahan
*Attorney, Agent, or Firm*—Michael I. Kroll

[57] ABSTRACT

A conveyor-type three dimensional parking system which comprises a storage structure having an entrance port and an exit port. A conveyor assembly is built into the storage structure for holding a plurality of motor vehicles. A pair of gates are provided to cover the entrance port and the exit port of the storage structure. A facility, operated by each driver is for actuating the entrance gate to open, so that each driver can drive their motor vehicle through the entrance port and into the conveyor assembly in the storage structure. A mechanism, operated by each driver, is for actuating the exit gate to open, so that each driver can retrieve their motor vehicle from the conveyor assembly and then drive out through the exit port of the storage structure.

2 Claims, 6 Drawing Sheets

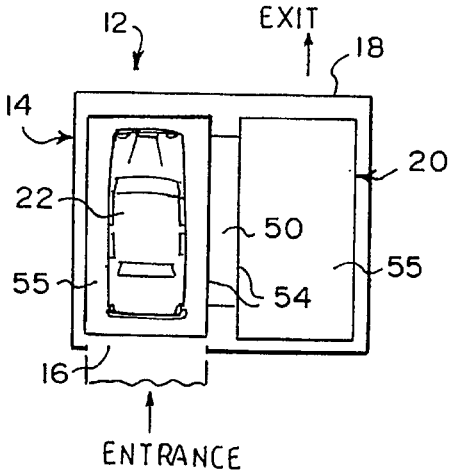
Fig. 1b
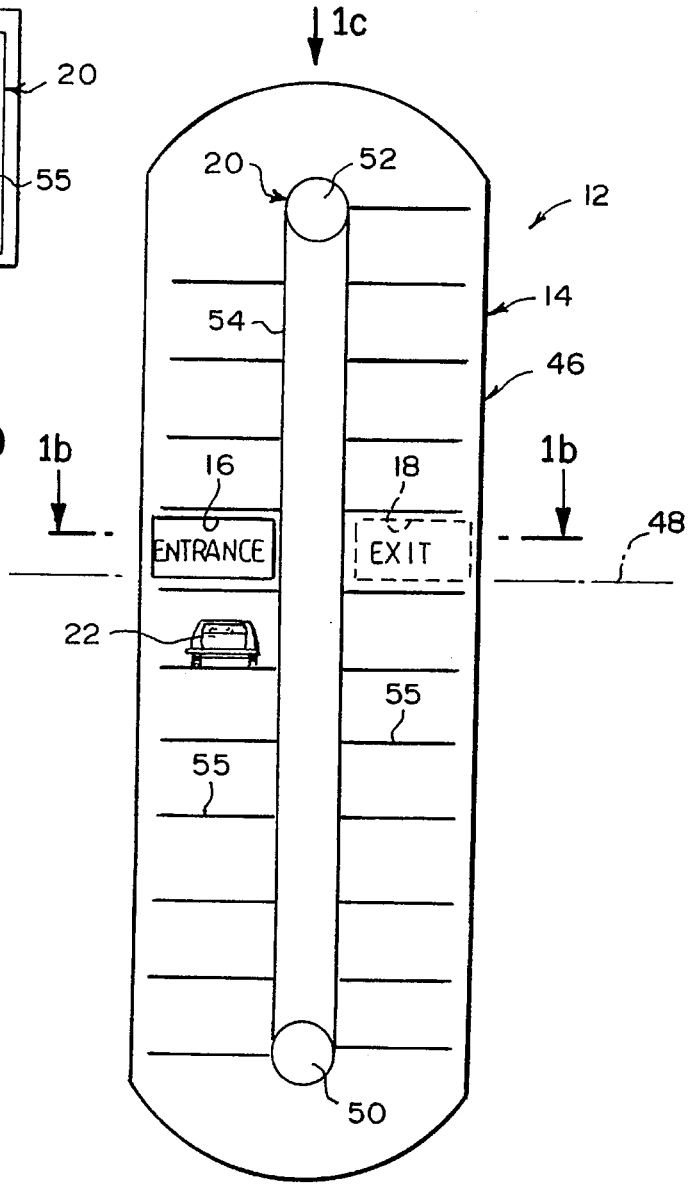
Fig. 1a
Fig. 1c
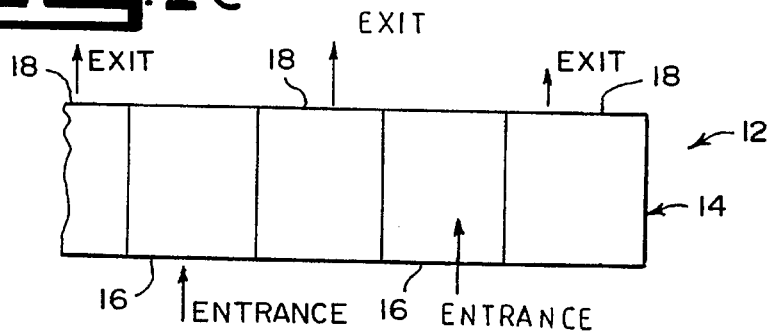

CONVEYOR-TYPE THREE DIMENSIONAL PARKING SYSTEM

BACKGROUND OF THE INVENTION

1. Field of the Invention

The instant invention relates generally to parking garages and more specifically it relates to a conveyor-type three dimensional parking system.

2. Description of the Prior Art

Numerous parking garages have been provided in prior art. For example, U.S. Pat. No. 4,850,784 to Salloum; U.S. Pat. No. 5,018,926 to Sternad; U.S. Pat. No. 5,203,660 to Takahiro and U.S. Pat. No. 5,330,305 to Go all are illustrative of such prior art. While these units may be suitable for the particular purpose to which they address, they would not be as suitable for the purposes of the present invention as heretofore described.

SALLOUM, CHARLES R.

CROSS FLOW MULTILEVEL PARKING SYSTEM

U.S. Pat. No. 4,850,784

In an automated multilevel rotary parking system double flow through vehicle paths including endless conveyors and elevators together with rotary parking platforms maximize vehicle handling capabilities. Vehicle flow paths are particularly arranged to facilitate vehicle movement in a rapid and orderly manner.

STERNAD, WILLIAM A.

AUTOMATIC STORAGE AND RETRIEVAL APPARATUS

U.S. Pat. No. 5,018,926

Storage and retrieval apparatus and method using pallets for storing vehicles and other loads. A number of storage levels aligned vertically are reached by a pair of lifts in shafts which bracket the levels. A transfer mechanism can push a pallet and automobile from either lift onto any level. Each level is always filled with pallets and sized to exactly hold an integral number of pallets. When a pallet is pushed into a level from one lift the intermediate pallets are pushed laterally to the opposite lift, resulting in the farthest pallet being ejected onto the opposite lift located at the same level. Separate loading stations are provided on ground level for each lift. An automobile can be driven on or off a pallet or a load placed on or off a pallet at the loading station. A loading station mechanism can move a pallet with a load to be stored from the loading station onto a lift. The lift transfer mechanism can transfer a pallet with a load being retrieved from the lift onto the loading station mechanism adjacent the lift, and the loading station mechanism can move the pallet from there to the loading station. A computer having input apparatus, input sensors, output apparatus and displays, utilizes a program to control and optimize the operation. Input identifiers for each automobile, or other load, and pallet are entered into the computer upon storage to permit ready retrieval.

TAKAHIRO, TSUBOTA

MULTISTORY PARKING SPACE

U.S. Pat. No. 5,203,660

A multistory parking space that is provided with an entrance and exit area, an elevator, power carriers and parking pallets. A vehicle in the entrance and exit area is transported by the elevator to the power carriers, and then the vehicle is transported to the parking pallets by the power carrier. All of these elements are provided with conveyors for transferring a vehicle. Entrance and exit of vehicles to and from the entrance and exit area, vertical traveling of the elevator, traveling of the power carrier are executed simultaneously to shorten the time required for entrance and exit.

GO, JUNICHI

DRIVEN MECHANISM FOR A THREE DIMENSIONAL VEHICLE PARKING SYSTEM

U.S. Pat. No. 5,330,305

A three dimensional parking system includes a plurality of housing stations which are arranged in a vertical direction for accommodating vehicles. A lift compartment is provided adjacent to the housing stations. Lifts are vertically movable in the lift compartment while carrying a vehicle thereon. A movable platform carries the vehicle, and is capable of transferring the vehicle to and from the lifts. The platform includes drive wheels, a drive motor for driving the drive wheels and an energy storage device. The energy storage device supplies electrical power to the drive motor when the platform is driven. Therefore, the platform moves between the housing stations and the lift compartment under its own ability.

SUMMARY OF THE INVENTION

A primary object of the present invention is to provide a conveyor-type three dimensional parking system that will overcome the shortcomings of the prior art devices.

Another object is to provide a conveyor-type three dimensional parking system that utilizes a conveyor assembly built into a storage structure to hold many motor vehicles in a small area.

An additional object is to provide a conveyor-type three dimensional parking system in which a credit card scanner and security card dispenser unit will facilitate a safer way of placing and retrieving the motor vehicles into and out of the storage structure.

A further object is to provide a conveyor-type three dimensional parking system that is simple and easy to use.

A still further object is to provide a conveyor-type three dimensional parking system that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of a first embodiment of the instant invention.

FIG. 1*a* is a diagrammatic elevational view of a second embodiment of the instant invention.

FIG. 1*b* is a diagrammatic cross sectional view taken along line 1*b*—1*b* in FIG. 1*a*.

FIG. 1*c* is a diagrammatic top view taken in the direction of arrow 1*c* in FIG. 1*a*, showing a side by side arrangement thereof.

Similar reference characters denote corresponding features consistently throughout the attached drawings.

DETAILED DESCRIPTION OF THE PREFERRED EMBODIMENTS

Figure 1:
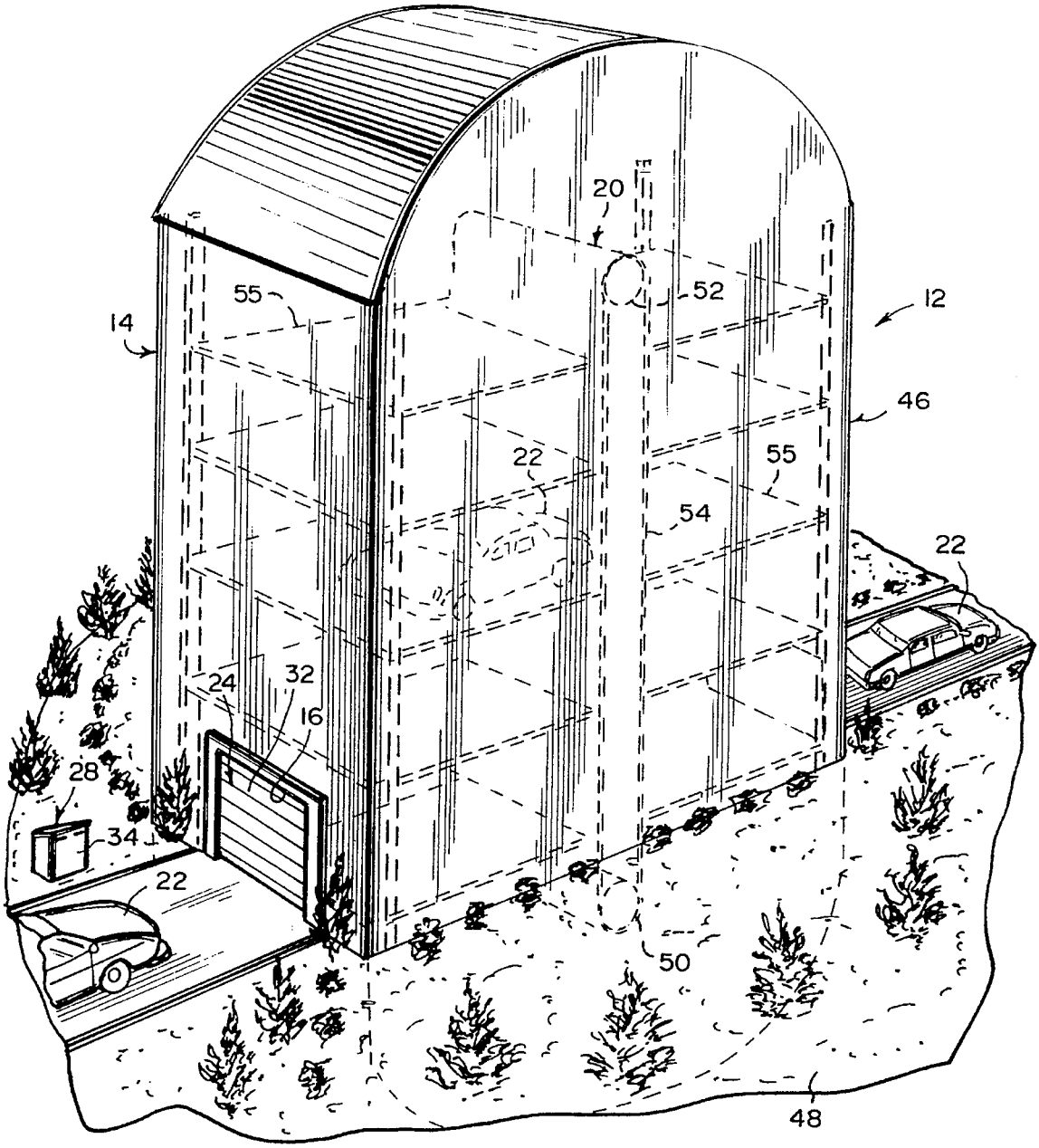

Turning now descriptively to the drawings, in which similar reference characters denote similar elements throughout the several views, FIGS. 1 through 10 illustrate a conveyor-type three dimensional parking system 12, which comprises a storage structure 14 having an entrance port 16 and an exit port 18. A conveyor assembly 20 is built into the storage structure 14 for holding a plurality of motor vehicles 22. A pair of gates 24, 26 are provided, to cover the entrance port 16 and the exit port 18 of the storage structure 14. A facility 28, operated by each driver is for actuating the entrance gate 24 to open, so that each driver can drive their motor vehicle 22 through the entrance port 16 and into the conveyor assembly 20 in the storage structure 14. A mechanism 30, operated by each driver, is for actuating the exit gate 26 to open, so that each driver can retrieve their motor vehicle 22 from the conveyor assembly 20 and then drive out through the exit port 18 of the storage structure 14.

Figures 7, 8:
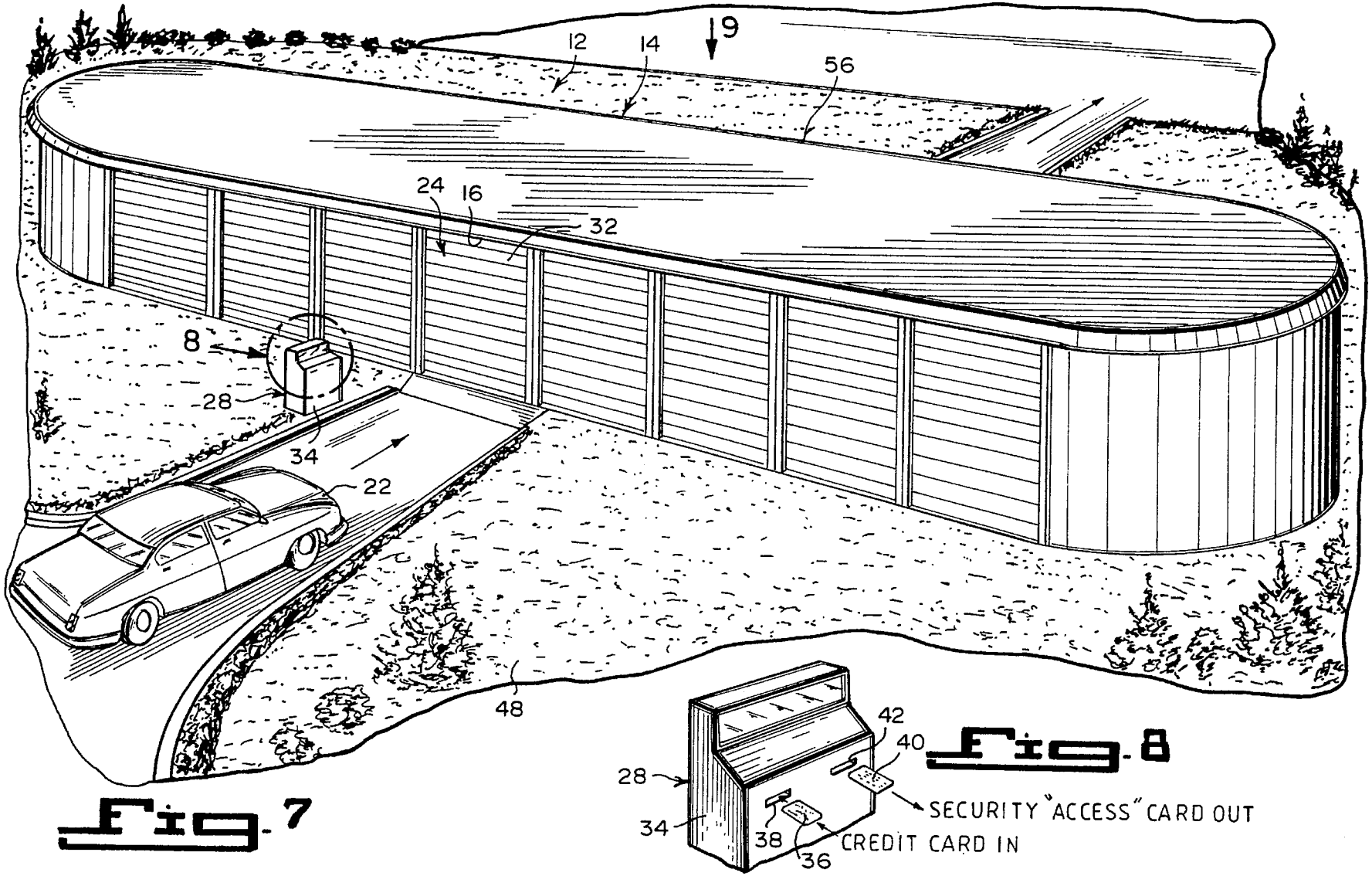
FIG. 7 is a perspective view of a fifth embodiment of the instant invention.
FIG. 8 is an enlarged perspective view as indicated by arrow 8 in FIG. 7 of the credit card scanner and security card dispenser.

Each gate 24, 26 is a vertically operated sliding garage door 32. The entrance gate actuating facility 28, as best seen in FIG. 8, is a credit card scanner and security card dispenser device 34, located adjacent to the entrance gate 24. When a driver inserts a credit card 36 into a credit card scanner slot 38 in the device 34, a security card 40 will be dispensed from a dispenser slot 42 in the device 34 and the entrance gate 24 will open.

The exit gate actuating mechanism 30 is a security card scanner apparatus 44 located adjacent to the exit gate 26. When a driver inserts the security card 40 into a scanner slot in the apparatus 44, the conveyor assembly 20 will operate to place the respective motor vehicle 22 behind the exit gate 26 and the exit gate 26 will open.

The storage structure 14, as shown in FIGS. 1 and 1*a*, is a garage building 46 vertically positioned with a lower portion embedded into the ground 48. The conveyor assembly 20 is positioned vertically within the garage building 46 and consists of a pair of spaced apart rollers 50, 52. The first roller 50 is located horizontally within the lower portion of the garage building 46. The second roller 52 is located horizontally within an upper portion of the garage building 46. A continuous conveyor belt 54 extends vertically between the rollers 50, 52. A plurality of horizontally maintained parking platforms 55 for the motor vehicles 22 are carried by the continuous conveyor belt 54.

The entrance port 16 and the exit port 18 of the storage structure 14, as shown in FIG. 1, are in alignment with the horizontally maintained parking platforms 55 of the conveyor assembly 20. The entrance port 16 and the exit port 18 of the storage structure 14, as shown in FIG. 1*a* and 1*b*, are offset at right angles to the horizontally maintained parking platforms 55 of the conveyor assembly 20. The conveyor assemblies 20 can be placed vertically and side by side within the storage structure 14, as in FIG. 1*c*. The storage structure 14 will have additional entrance ports 16 and exit ports 18 for the additional conveyor assemblies 20. The storage structure 14, in FIGS. 2, 3, 5, 6, 7 and 9, is a garage building 56 horizontally positioned with a lower portion embedded into the ground 48.

Figures 5, 6:
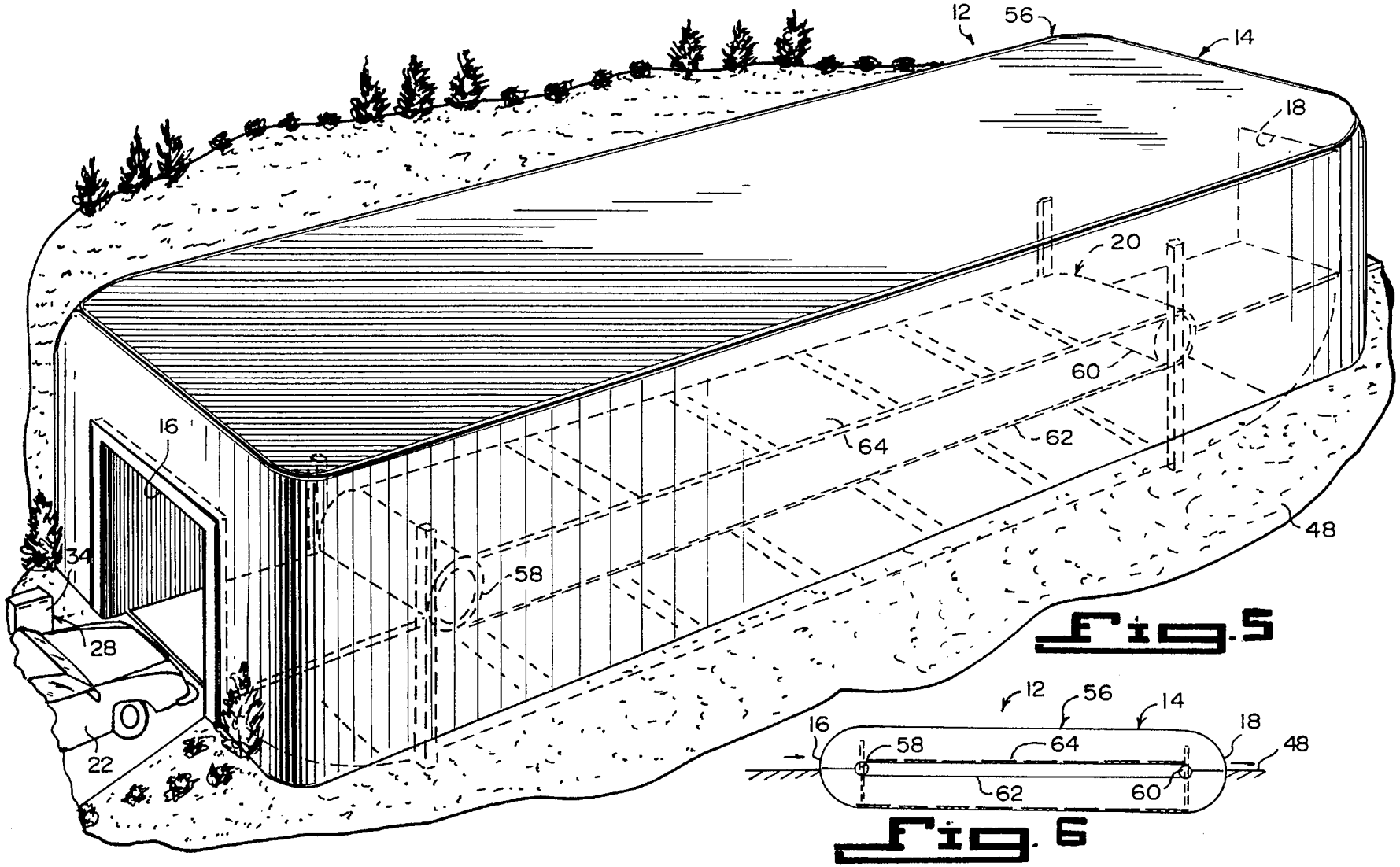
FIG. 5 is a perspective view of a fourth embodiment of the instant invention.
FIG. 6 is a diagrammatic longitudinal cross sectional view of FIG. 5.

The conveyor assembly 20, in FIGS. 5 and 6, is positioned horizontally within said garage building 56 and contains a pair of spaced apart rollers 58, 60. The first roller 58 is located horizontally within a left side of the garage building 56. The second roller 60 is located horizontally within a right side of the garage building 56. A continuous conveyor belt 62 extends horizontally between the rollers 58, 60. A plurality of horizontally maintained parking pallets 64 for the motor vehicles 22 are carried by the continuous conveyor belt 62. The entrance port 16 and the exit port 18 of the storage structure 14 are in alignment with the horizontally maintained parking pallets 64 of the conveyor assembly 20 at opposite ends of the continuous conveyor belt 62.

Figure 9:
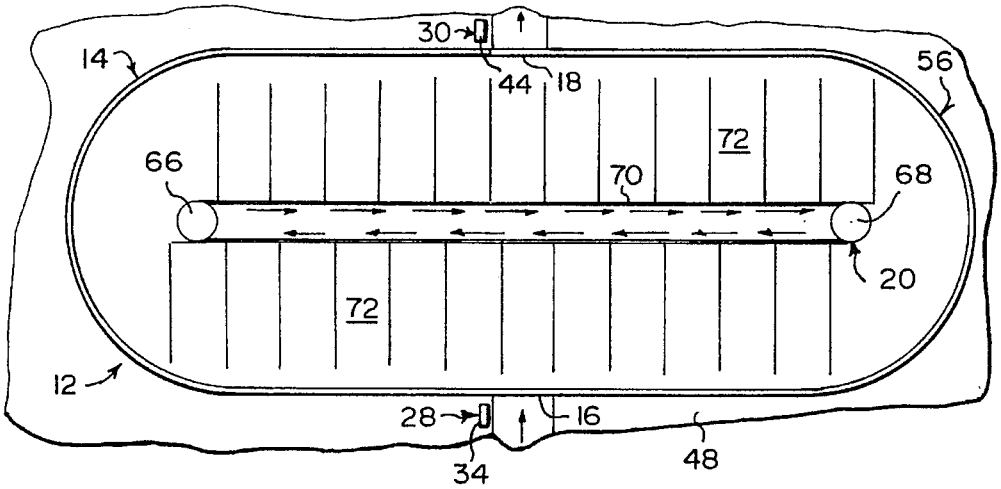
FIG. 9 is a diagrammatic top view taken in the direction of arrow 9 in FIG. 6 with the roof removed therefrom.
Figure 10:
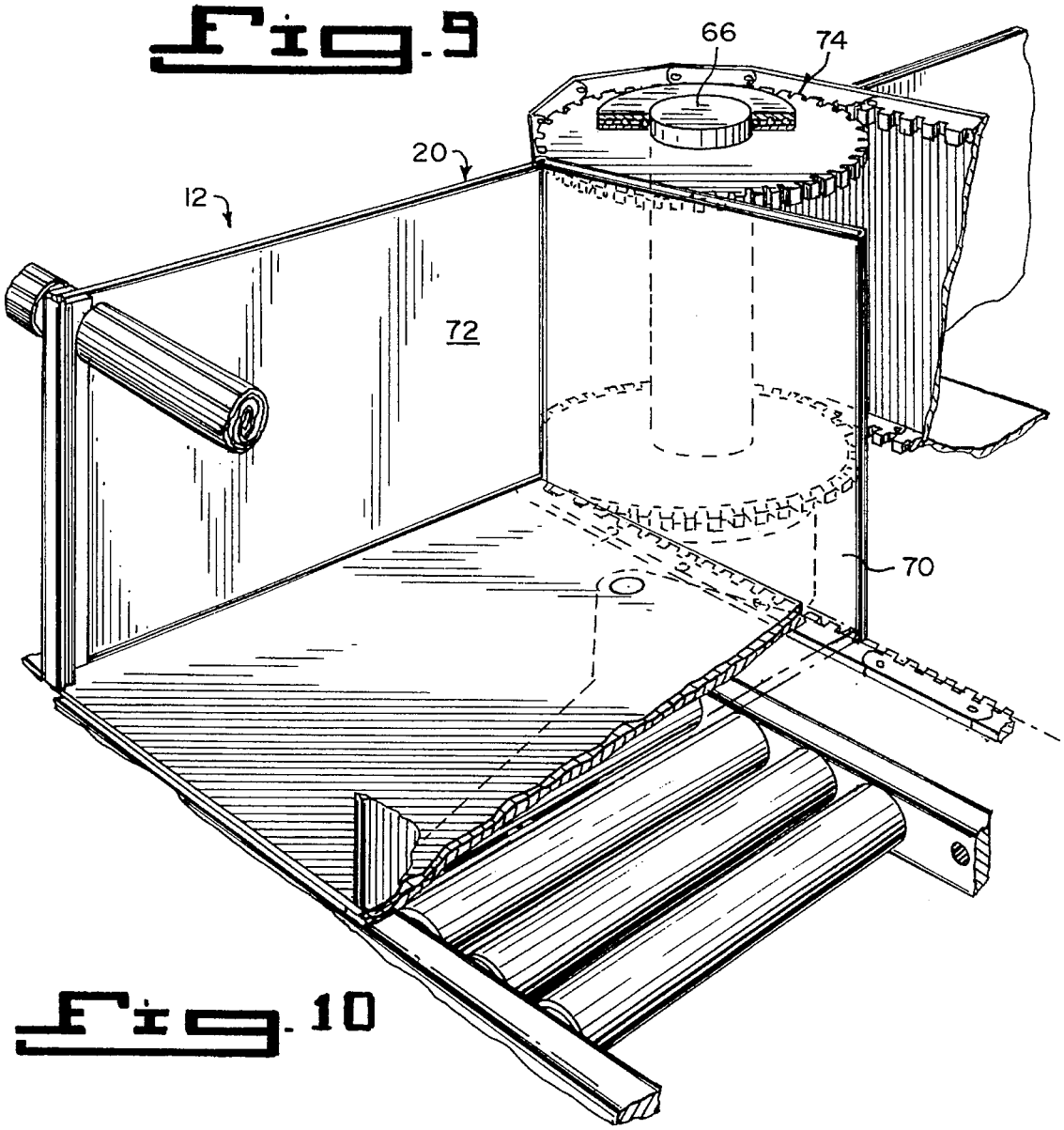
FIG. 10 is a perspective view of a portion of the conveyor unit shown in FIG. 4.

The conveyor assembly 20, in FIGS. 9 and 10, is positioned horizontally within the garage building 56 and includes a pair of spaced apart rollers 66, 68. The first roller 66 is located vertically within a left side of the garage building 56. The second roller 68 is located vertically within a right side of the garage building 56. A continuous conveyor belt 78 extends horizontally between the rollers 66, 68. A plurality of horizontally maintained parking stalls 72 for the motor vehicles 22 are carried by the continuous conveyor belt 70. The conveyor assembly 20, as shown in FIG. 10, further includes a sprocket and chain rack assemblage 74 between the rollers 66, 68 and the continuous conveyor belt 70. The entrance port 16 and the exit port 18 of the storage structure 14, as shown in FIG. 9, are in alignment with the horizontally maintained parking stalls 72 of the conveyor assembly 20, approximately midway at opposite sides of the continuous conveyor belt 70.

Figure 3:
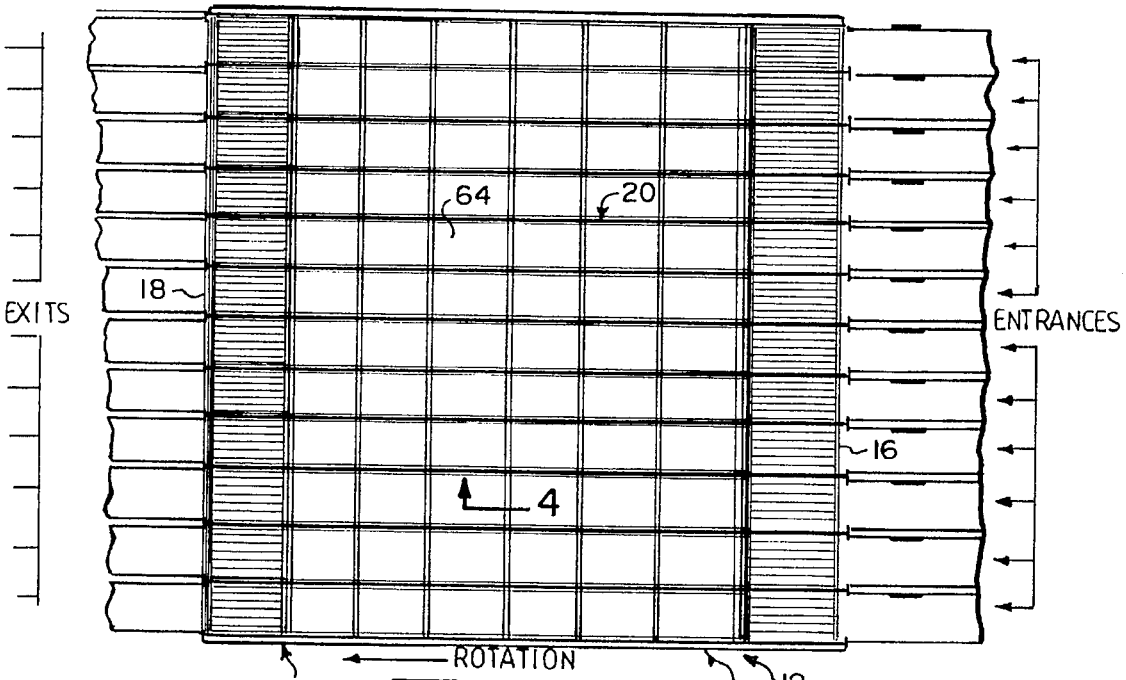
FIG. 3 is a top view taken in the direction of arrow 3 in FIG. 2 with the roof removed therefrom.
Figure 2:
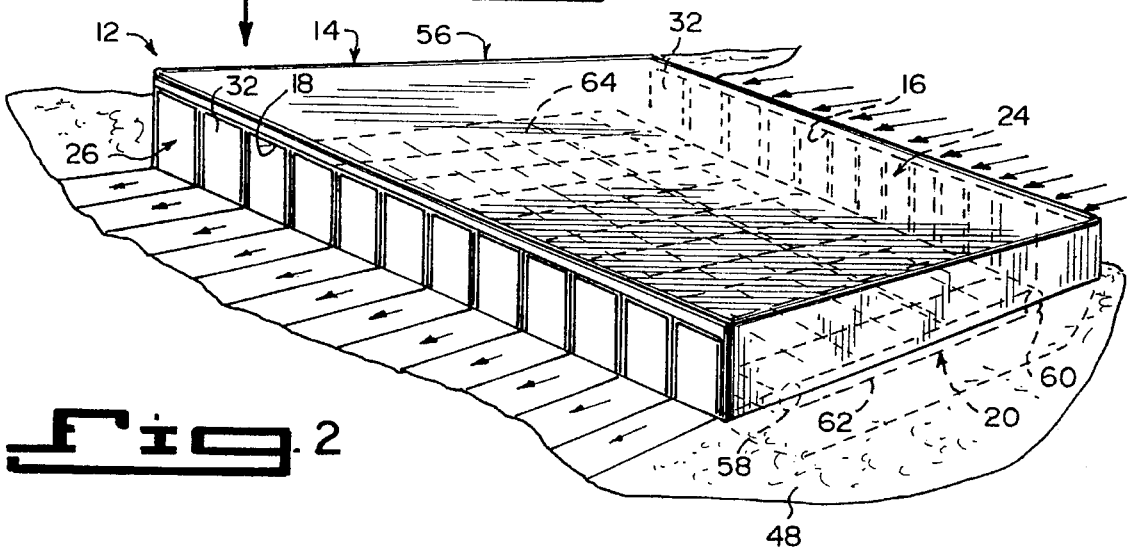
FIG. 2 is a perspective view of a third embodiment of the instant invention.
Figure 4:
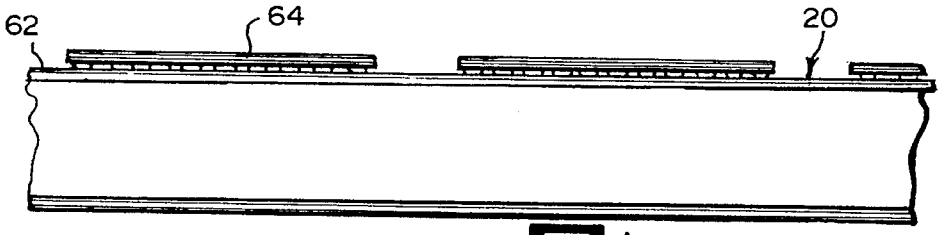
FIG. 4 is an enlarged side view of a portion of one conveyor unit as indicated by arrow 4 in FIG. 3.

As shown in FIGS. 2 and 3, a plurality of the conveyor assemblies 20 can be placed horizontally and side by side within the storage structure 14. The storage structure 14 will have additional entrance ports 16 and exit ports 18 at opposite ends of the continuous conveyor belts 62 of the additional conveyor assemblies 20.

| LIST OF REFERENCE NUMBERS | |
|---|---|
| 12 | conveyor-type three dimensional parking system |
| 14 | storage structure |
| 16 | entrance port of 14 |
| 18 | exit port of 14 |
| 20 | conveyor assembly in 14 |
| 22 | motor vehicle |
| 24 | entrance gate at 16 |
| 26 | exit gate at 18 |
| 28 | entrance gate actuating facility |
| 30 | exit gate actuating mechanism |
| 32 | vertically operated sliding garage door 24, 26 |
| 34 | credit card scanner and security card dispenser device for 28 |
| 36 | credit card |
| 38 | credit card scanner slot in 34 |
| 40 | security card |
| 42 | dispenser slot in 34 |
| 44 | security card scanner apparatus for 30 |
| 46 | vertical garage building for 14 |
| 48 | ground |
| 50 | first horizontal roller of 20 |
| 52 | second horizontal roller of 20 |
| 54 | continuous conveyor belt of 20 |
| 55 | parking platform of 20 |
| 56 | horizontal garage building for 14 |
| 58 | first horizontal roller of 20 |
| 60 | second horizontal roller of 20 |
| 62 | continuous conveyor belt of 20 |
| 64 | parking pallet of 20 |
| 66 | first vertical roller of 20 |
| 68 | second vertical roller of 20 |
| 70 | continuous conveyor belt of 20 |
| 72 | parking stall of 20 |
| 74 | sprocket and chain rack assemblage of 20 |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A conveyor-type three dimensional parking system which comprises:

a) a storage structure having an entrance port and an exit port comprising garage building extending above and below ground level with said entrance and exit ports at ground level at opposite sides of said building;

b) a conveyor assembly positioned vertically within said garage building for holding a plurality of motor vehicles and comprising a pair of spaced apart rollers in which the first roller is located below ground level and the second roller is located above ground level with a continuous conveyor belt extending vertically between said rollers, and a plurality of horizontally maintained parking platforms for the motor vehicles carried by said continous belt so that said platforms travel up one side of said building and down the opposite side of said building between and around said rollers, each platform having a stopping point aligned with said entrance port on one side of said building and a stopping point on the opposite side of said building aligned with said exit port;

c) a pair of power operated doors covering said entrance port and said exit port of said garbage building;

d) means operated by each driver for actuating said entrance door to open permitting each driver to drive a motor vehicle through said entrance port and onto platform at the stopping point aligned with said entrance port in said storage structure comprising a credit card scanner and security card dispensing device located adjacent to the entrance door to dispense a security card when said driver inserts a credit card into said credit card scanner and causing said entrance door to open permitting said driver to enter and park said motor vehicle on the platform aligned with said entrance port; and e) means operated by each driver for actuating said conveyor assembly to deliver said motor vehicle to the stopping point aligned with said exit port and the exit door to open comprising a security card scanner located adjacent to said exit door so that each driver can retrieve said motor vehicle from said conveyor assembly and then drive out through said exit port of said storage structure when said driver inserts said security card into said security card scanner causing said conveyor assembly to operate to place said motor vehicle behind said exit door and said exit door to open.

2. A conveyor-type three dimensional parking system as recited in claim 1, wherein each said door is a vertically operated sliding garage door.

* * * * *